US005230180A

United States Patent [19]

Tweedt et al.

[11] Patent Number: 5,230,180

[45] Date of Patent: Jul. 27, 1993

[54] DOOR HAVING HIDDEN SCREW CONSTRUCTION

[75] Inventors: Robert C. Tweedt, Ankeny; Brad E. Pingel, Des Moines, both of Iowa

[73] Assignee: Emco Enterprises, Inc., Des Moines, Iowa

[21] Appl. No.: 863,103

[22] Filed: Apr. 3, 1992

[51] Int. Cl.[5] ..... E06B 1/12; E06B 7/16

[52] U.S. Cl. ..... 49/400; 49/490.1; 49/495.1; 49/504; 52/211; 52/213

[58] Field of Search ..... 52/213, 214, 215, 210, 52/211, 212, 204; 49/495, 488, 490

[56] References Cited

U.S. PATENT DOCUMENTS

| | | | |
|---|---|---|---|
| 1,187,544 | 6/1916 | Olberg | 52/214 |
| 2,190,954 | 2/1940 | Stickel | 49/495 |
| 3,287,856 | 11/1966 | Passovoy | 49/495 |
| 3,456,390 | 7/1969 | Hulverson et al. | 49/495 |
| 3,609,928 | 10/1971 | Mock | 52/214 |
| 3,690,037 | 9/1972 | Kempel | 49/489 |
| 3,788,019 | 1/1974 | Kiselewski | 52/214 |
| 3,851,420 | 12/1974 | Tibbetts | 49/495 |
| 3,924,373 | 12/1975 | Lizdas et al. | 52/213 |
| 4,034,514 | 7/1977 | Cecil | 52/213 |
| 4,281,481 | 8/1981 | Wendt | 52/213 |
| 4,443,984 | 4/1984 | Rasmussen | 52/213 |
| 4,658,548 | 4/1987 | Gerritsen . | |

*Primary Examiner*—Michael Safavi

*Attorney, Agent, or Firm*—Zarley, McKee, Thomte, Voorhees & Sease

[57] ABSTRACT

A door assembly having hidden screw construction includes a plurality of elongated brackets positioned around the side jambs and header of a door opening. The brackets each include elongated U-shaped channels extending along the length thereof. Screws are threaded through the bottom walls of the channels into the frame of the door so as to secure the brackets to the door. An elongated cover strip extends along the length of each channel and is detachably secured thereto in covering relation over the heads of the screws to hide the heads of the screws from view.

11 Claims, 2 Drawing Sheets

DOOR HAVING HIDDEN SCREW CONSTRUCTION

BACKGROUND OF THE INVENTION

The present invention relates to a door having a hidden screw construction.

Typical storm door construction involves the use of aluminum extrusion Z-bars which extend around the door opening. These Z-bars are fastened to the margins of the door opening by means of screws which extend through the Z-bars into the front face of the frame surrounding the door opening. In many prior art assemblies, these screws are exposed to view, thereby detracting from the aesthetic appearance of the door. Furthermore, these screws are often unprotected from being struck by objects or otherwise exposed to wear resulting in the loosening of the screws over extended periods of time.

Therefore, a primary object of the present invention is the provision of an improved door assembly having a hidden screw construction.

A further object of the present invention is the provision of an improved door assembly having cover strips which hide the screws from view.

A further object of the present invention is the provision of an improved door assembly having easily insertable or removable cover strips for covering the screws.

A further object of the present invention is the provision of an improved door construction which provides structural protection for the heads of the screw so as to minimize exposing the screw to wear and tear which might loosen the screw.

A further object of the present invention is the provision of an improved door having hidden screw construction which is economical to manufacture, durable in use, and inefficient in operation.

SUMMARY OF THE INVENTION

The present invention utilizes a plurality of elongated bracket members which are positioned around a door opening in engagement with the door header and with the opposite side jams of the door. One or more of the bracket members include an elongated U-shaped channel therein extending along its length. The U-shaped channel comprises in cross-section a channel bottom wall which faces the front face of the door opening, and a pair of spaced apart channel side walls which extend outwardly from the front face of the door opening. Screws extend through the bottom wall of the channel and are threaded into the door jambs and headers of the door frame so as to secure the bracket members to the door frame. The heads of the screws are contained within the channels so that they are protected by the side walls of the channel.

Elongated cover strips extend along the lengths of each channel and are detachably secured thereto in covering relation over the heads of the screws so as to hide the heads of the screws from view. The cover strips include a cap portion and two spaced apart legs extending from the cap portion into the channel. The side legs of the cover strip each include an outwardly extending protrusion which engages inwardly extending lips of the side walls so as to retain the cover strip within the channel. The cover strip is preferably made of PVC plastic, and the legs of the cover strip are yieldable inwardly so as to permit easy insertion and removal of the legs into the channel. The cap portion of each cover strip provides a smooth continuous surface covering the open ends of the channels and covering the screws contained within the channels so as to improve the aesthetic appearance of the door assembly.

DESCRIPTION OF THE PREFERRED EMBODIMENT

Figure 3:
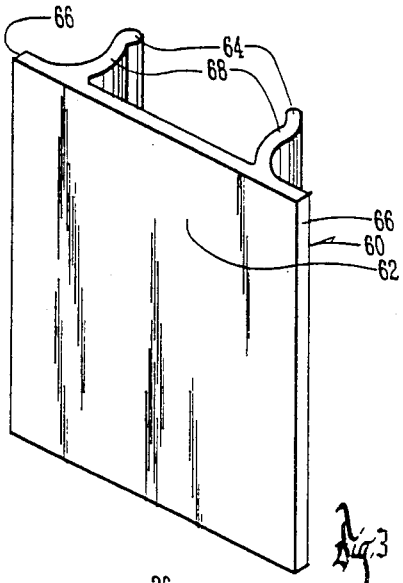
FIG. 3 is an enlarged perspective view of the cover strip of the present invention.
Figure 1:
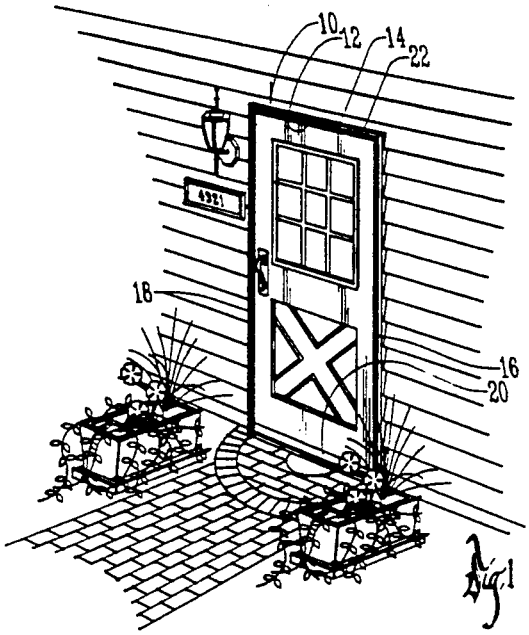
FIG. 1 is a perspective view of a door mounted within a door opening of an exterior wall.

Referring to the drawings, the numeral 10 generally designates a door which is mounted within a door opening 12 surrounded by a header Z-bar 14, a pair of spaced apart jamb Z-bars 16, 18, and a threshold 20. Header Z-bar 14 is mounted to a header 22 (FIG. 2) which forms the upper margin of the door opening 12 and which includes a downwardly presented surface 24 and a forwardly presented surface 26. Door opening 12 also includes at its sides a pair of spaced apart side jambs 28, 30 each of which includes an inwardly presented surface 32 and a forwardly presented surface 34.

Header Z-bar 14 includes a stop flange 36, a middle flange 38 embracing the downwardly presented surface 24 of header 22, and a front flange 40 which is fitted in facing relation to the front surface 26 of header 22. Extending forwardly from front flange 40 is an elongated channel 42 formed by two channel side walls 44, 46 and a channel bottom wall 48. A screw 50 is one of a plurality of screws, evenly spaced, each of which includes a screw head 52 and a screw shank 54 extending through channel bottom wall 48 into the header 22 so as to secure the header Z-bar 14 to the header 22. Channel side walls 44, 46 terminate in inwardly extending lips 56, 58 which are facing one another and which are spaced apart from one another.

Figure 4:
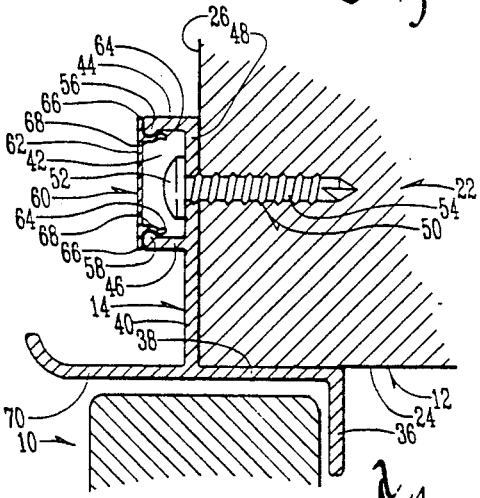
FIG. 4 is a sectional view taken along line 4—4 of FIG. 2.

A cover strip 60 includes a cap portion 62 and a pair of spaced apart legs 64 which extend from cap portion 62 into the channel 42. The cap portion 62 extends outwardly beyond the two spaced apart legs 64 so as to form a pair of cap flanges 66 which engage and cover the outer edges of channel side walls 44, 46 as can be seen in FIG. 4. Each leg 64 of cover strip 60 includes an outwardly projecting node 68 which extends downwardly below the lips 56 and which engages one of the lips 56 to hold the cover strip 60 within the channel 42. The legs 64 are flexible and can yield inwardly toward one another so as to permit the nodes 68 to cam inwardly around the lips 56, 58 of channel side walls 46, 48 during insertion and removal of the cover strip 60 into channel 48. A drip cap flange 70 extends forwardly from header Z-bar 14 and lies in covering relation over door 10 so as to prevent water from draining onto door 10.

Figure 6:
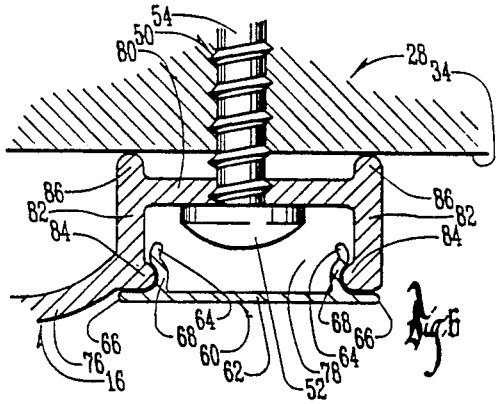
FIG. 6 is an enlarged detailed view of the portion FIG. 5 surrounded by line 6—6.
Figure 5:
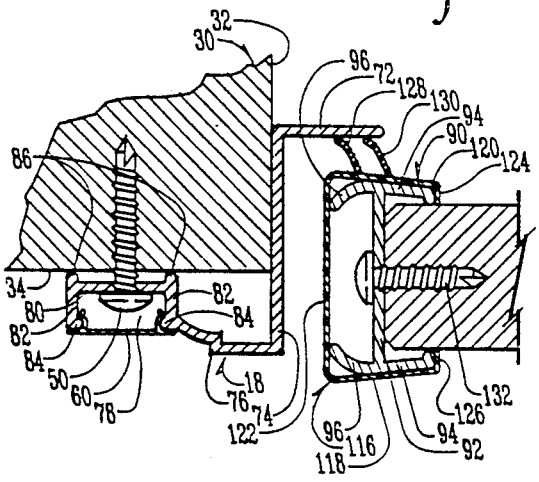
FIG. 5 is a sectional view taken along line 5—5 of FIG. 2.
Figure 5:
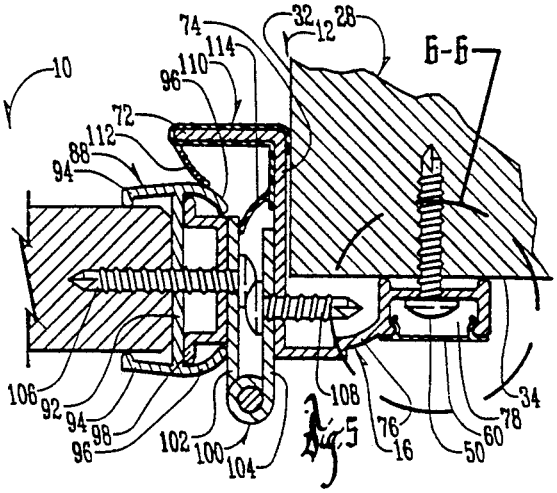
Figure 2:
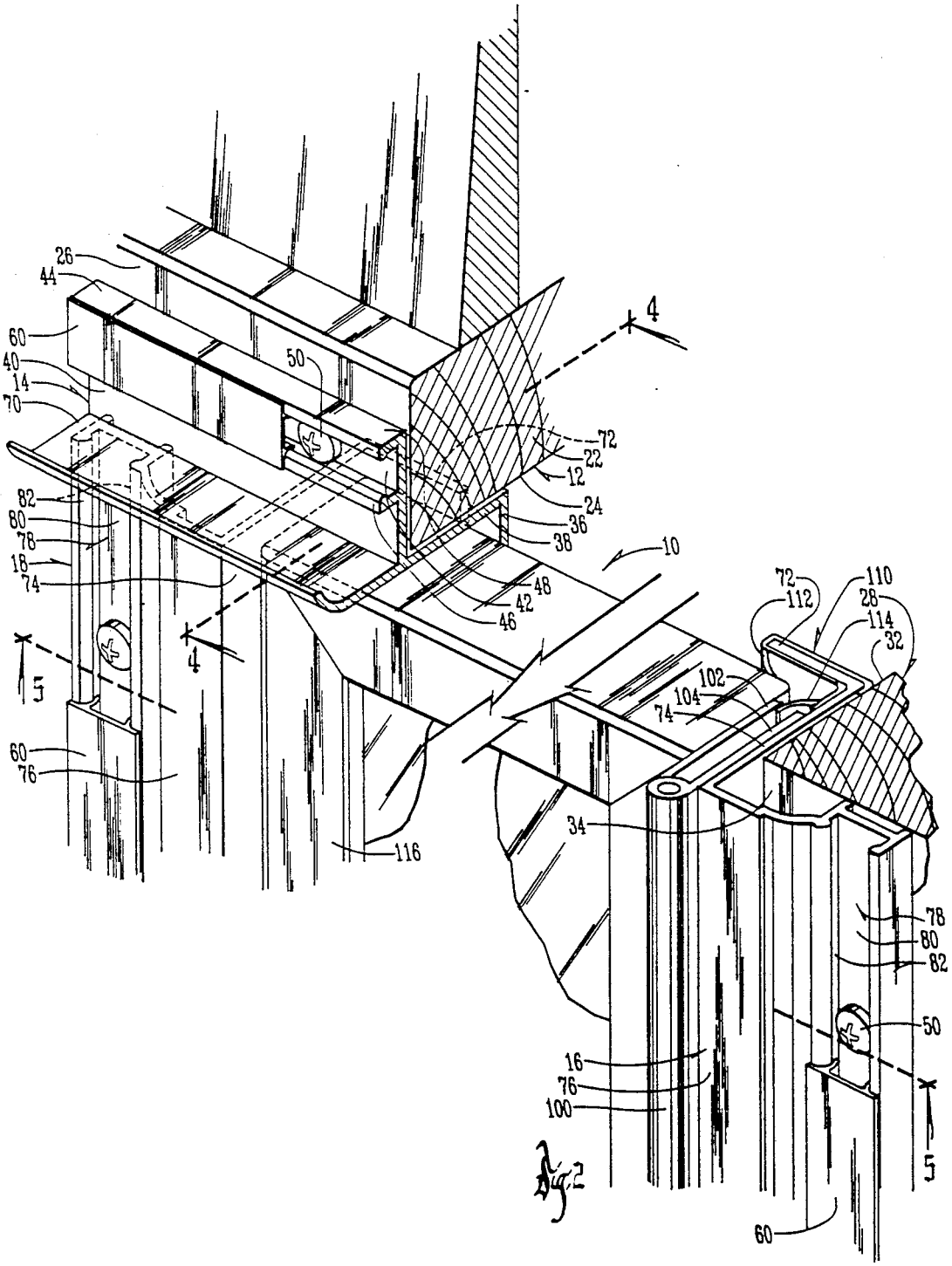
FIG. 2 is a detailed perspective view of the door assembly showing various portions in cross-section.

FIGS. 2, 5, and 6 illustrate the construction of the jamb Z-bars 16, 18, which are identical in construction.

Z-bars 16, 18 each include a back flange 72, a middle flange 74, and a front flange 76. Middle flanges 74 face the side jambs 28, 30, and front flanges 76 face the front surfaces 34 of the side jambs 28, 30. Front flanges 76 are each provided with a vertically extending channel 78 having a channel bottom wall 80, and channel side walls 82. The side walls 82 are provided with inwardly extending lips 84. A pair of stand-offs 86 hold the channel bottom wall 80 in spaced facing relation to the front surface 34 of side jambs 28, 30. A plurality of screws 50 identical in construction to the screw 50 shown in FIG. 4 extend through channel bottom wall 80 and into the front surface 34 of side jamb 28.

Referring to FIG. 5, door 10 includes a pair of H-shaped channels 88, 90 mounted over its opposite vertical edges. Channels 88, 90 are identical in construction and include a web 92 which is in facing relation to the vertical edge of the door 10. A pair of spaced apart gripping flanges 94 extend from the opposite edges of web 92 and embrace the front and rear surfaces of door 10 along its vertical edge. Extending from web 92 in a direction opposite from gripping flanges 94 are a pair of spaced apart arcuate flanges 96.

On the hinge side of the door 10 a hinge bracket 98 which is hat shaped in cross-section is fitted between arcuate flanges 96 and is capable of sliding vertically in the channel provided by arcuate flanges 96. While hinge bracket 98 is shown mounted between the arcuate flanges 96 of channel 88, it also can be mounted between the arcuate flanges 96 of channel 90. This construction makes possible the reversibility of the hinge side of the door as needed.

A hinge 100 includes a pair of hinged flaps 102, 104. Flap 102 is attached to hinge bracket 98 by means of a screw 106 which extends through the hinge bracket 98 and through the web 92 into the edge of the door 10 so as to secure the hinge 100, the hinge bracket 98, and the H-shaped channel 88 to the door. A screw 108 extends through the hinge flap 104 of hinge 100 and through the middle flange 74 of Z-bar 16 so as to secure the hinge 100 to the Z-bar 16. Preferably hinge bracket 98 and flap 102 of hinge 100 are preassembled and attached to one another by rivots (not shown) or other fastening means.

Fitted over back flange 72 and partially embracing middle flange 74 is a plastic L-shaped sheath 110 which includes a pair of sealing fins 112, 114 for engaging the hardware at the edge of door 10 to create a seal as shown in FIG. 5.

The latch edge of door 10 is provided with a plastic edge cap 116 having a pair of spaced apart cap side flanges 118, 120 interconnected by a cap web 122. The ends of flanges 118, 120 are provided with inwardly extending lips 124, 126 which surround and embrace the inner edges of gripping flanges 94. A pair of sealing fins 128, 130 extend from cap side flange 120 and are adapted to engage the back flange 72 of Z-bar 18 as shown in FIG. 5 when the door is closed. A plurality of screws 132 extend through web 92 of H-shaped channel 90 to secure H-shaped channel 90 to the edge of door 10. These screws fit in the channel provided by flanges 96 and are covered from view by the web 122 of edge cap 116.

The cover strips 60 provide protection of the various screws 50 within channels 42 and 78 along the top edge and side edges of door 10. Furthermore, the channel side walls 44, 46 of channels 42, 78 protect the screws 50 from being engaged or struck by objects throughout extended use of the door. This minimizes the likelihood that the screws 50 will become loosened.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

We claim:

1. A door assembly adapted to be mounted within a door opening surrounded by a door frame comprising a door header, and first and second side jambs each including a front surface and an inwardly presented surface which is perpendicular to said front surface, said inwardly presented surfaces facing one another, said door assembly comprising:

first and second side Z-bars attached to said first side jamb and said second side jamb, respectively and a header Z-bar mounted to said door header;

each of said header, first and second Z-bars comprising in cross section a front flange in facing relation to said front surface of said header, first and second side jambs respectively, a middle flange in facing relation to said inwardly presented surface of said header, first and second side jambs respectively and a back flange connected to said middle flange and extending inwardly into said door opening;

said front flanges each having an elongated U-shaped channel therein comprising in cross section a channel bottom wall and a pair of spaced apart channel sidewalls each having a lower end connected to said bottom wall and an upper end;

screw means securing said front flanges of said header, first and second Z-bars to said header, first and second jambs, said screw means each having a head and shank, said heads being within said channels and said shanks extending through said bottom walls of said channels and into said header first and second side jambs respectively;

an elongated cover strip extending along the length of each of said channels and being detachably secured thereto in covering relation over said heads of said screw means to hide said heads of said screw means from view;

a door fitted within said door opening and having a hinge edge adjacent said first Z-bar and a latch edge adjacent said second Z-bar;

hinge means connecting said hinge edge of said door to said first Z-bar;

an elongated edge cap means mounted to said latch edge of said door and having a pair of elongated sealing fins extending along the length thereof and sealingly engaging said back flange of said second Z-bar;

an L-shaped sheath means fitted in covering relationship over said back flange and partially embracing said middle flange of said first Z-bar, said sheath means including a pair of elongated sealing fins engaging said hinge means for creating a seal between said door and said first side jamb.

2. A door assembly adapted to be mounted within a door opening surrounded by a door frame comprising a door header, and first and second side jambs each including a front surface and an inwardly presented surface which is perpendicular to said front surface, said inwardly presented surfaces facing one another, said door assembly comprising:

first and second side Z-bars attached to said first side jamb and said second side jamb, respectively and a header Z-bar mounted to said door header;

each of said header, first and second Z-bars comprising in cross section a front flange in facing relation to said front surface of said header, first and second side jambs respectively, a middle flange in facing relation to said inwardly presented surface of said header, first and second side jambs respectively and a back flange connected to said middle flange and extending inwardly into said door opening;

said front flanges each having an elongated U-shaped channel therein comprising in cross section a channel bottom wall and a pair of spaced apart channel sidewalls each having a lower end connected to said bottom wall and an upper end including lips extending toward one another and terminating in spaced relation to one another;

screw means securing said front flanges of said header, first and second Z-bars to said header, first and second jambs, said screw means each having a head and shank, said heads being within said channels and said shanks extending through said bottom walls of said channels and into said header first and second side jambs respectively;

an elongated cover strip including a cap portion extending along the length of each of said channels in covering relation over said channel and an attachment portion extending between and being retentively engaged by said spaced apart lips of said pair of spaced apart channel side walls to hide said heads of said screw means from view;

a door fitted within said door opening and having a hinge edge adjacent said first Z-bar and a latch edge adjacent said second Z-bar;

hinge means connecting said hinge edge of said door to said first Z-bar;

an elongated edge cap means mounted to said latch edge of said door and having a pair of elongated sealing fins extending along the length thereof and sealingly engaging said back flange of said second Z-bar;

an L-shaped sheath means fitted in covering relationship over said back flange and partially embracing said middle flange of said first Z-bar, said sheath means including a pair of elongated sealing fins engaging said hinge means for creating a seal between said door and said first side jamb.

3. The door assembly of claim 2 wherein said header Z-bar includes a drip cap flange extending forwardly from said header Z-bar and lying in covering relation over said door so as to prevent water from draining onto said door.

4. A door assembly according to claim 2 wherein said attachment portion of said cover strip comprises a pair of spaced apart legs extending between and being retentively engaged by said spaced apart lips of said pair of channel side walls.

5. A door assembly according to claim 4 wherein each of said spaced apart legs include in cross-section a node extending within said channel and protruding toward one of said side walls so as to engage one of said spaced apart lips and be held by said one lip against movement out of said channel.

6. A door assembly according to claim 5 wherein said spaced apart legs of said cover strip are yieldably movable toward one another from a retaining position engaging said lips to attach said cover strip to said channel to a release position permitting said nodes to move past said lips for removal of said legs from said channel.

7. A door assembly according to claim 6 wherein said upper ends of said pair of channel side walls each include an upwardly presented wall edge having a predetermined thickness, said cap portion of said cover strip extending between said spaced apart legs of said cover strip and having cover flanges extending outwardly beyond said spaced apart legs, said cover flanges extending over and covering said wall edges of said channel side walls.

8. A door assembly according to claim 2 wherein said header Z-bar extends along said door header, said shank of said screw means being threaded into said door header to attach said header Z-bar to said door header.

9. A door assembly according to claim 2 wherein said first side Z-bar extends along said first side jamb, said shank of said screw means being threaded into said first side jamb to attach said first side Z-bar to said side jamb.

10. A door assembly according to claim 9 wherein said first and second side jambs each include a front surface extending in a plane parallel to the plane defined by said door opening, said first and second jambs each having a jamb surface extending in a plane perpendicular to said front surface, said channel bottom wall having a rearwardly presented surface facing said front surface of said side jamb, said channel side walls extending from said channel bottom wall in a direction away from said front surface of said jamb.

11. A door assembly according to claim 10 wherein said cap portion of said cover strip is flat and lies in a plane parallel to said bottom wall of said channel and parallel to said front surface of said side jamb.

* * * * *